US011873835B2

(12) United States Patent
Tzeng

(10) Patent No.: US 11,873,835 B2
(45) Date of Patent: Jan. 16, 2024

(54) MANUFACTURING METHOD OF AXIAL AIR MOVING DEVICE WITH BLADES OVERLAPPED IN AXIAL PROJECTION

(71) Applicant: Stokes Technology Development Ltd., Taoyuan (TW)

(72) Inventor: Yih-Wei Tzeng, Taoyuan (TW)

(73) Assignee: STOKES TECHNOLOGY DEVELOPMENT LTD., Taoyuan (TW)

( * ) Notice: Subject to any disclaimer, the term of this patent is extended or adjusted under 35 U.S.C. 154(b) by 200 days.

(21) Appl. No.: 17/218,157

(22) Filed: Mar. 31, 2021

(65) Prior Publication Data

US 2022/0316494 A1 Oct. 6, 2022

(51) Int. Cl.
*F04D 29/38* (2006.01)
*F04D 29/32* (2006.01)

(52) U.S. Cl.
CPC ..... *F04D 29/386* (2013.01); *F04D 29/329* (2013.01)

(58) Field of Classification Search
CPC ..... F04D 29/386; F04D 29/329
USPC ..... 416/223 R
See application file for complete search history.

(56) References Cited

U.S. PATENT DOCUMENTS 2,985,952 A * 5/1961 Chang ..... B23P 15/006 416/223 R
3,837,612 A * 9/1974 Deters ..... F04D 1/06 249/105
4,080,096 A * 3/1978 Dawson ..... F04D 29/181 415/72
4,093,401 A * 6/1978 Gravelle ..... F04D 29/284 416/185
5,088,798 A * 2/1992 Stalter, Sr. ..... B60B 5/02 301/37.42
5,290,149 A * 3/1994 Vieth ..... F04D 29/325 416/223 R
5,766,469 A * 6/1998 Boast ..... B29C 45/14467 137/550
6,296,566 B1 * 10/2001 Tanis ..... A01F 12/10 460/68
6,318,964 B1 * 11/2001 Yang ..... F04D 29/325 416/185
6,623,265 B1 * 9/2003 Day ..... B29C 33/44 249/59
6,692,231 B1 * 2/2004 Calvert ..... F04D 29/36 416/207
6,779,992 B2 * 8/2004 Lei ..... F04D 29/023 416/212 R (Continued)

*Primary Examiner* — Phutthiwat Wongwian
*Assistant Examiner* — John D Bailey
(74) *Attorney, Agent, or Firm* — Chun-Ming Shih; HDLS IPR SERVICES

(57) ABSTRACT

A manufacturing method of an axial air moving device. A model of the axial air moving device includes a hub and blades. The axial projection of blades is partially overlapped in the axial direction of the hub. The model of the axial air moving device is parted in the axis direction of the hub. The blades are divided into multiple parting models non-overlapped in the axial projection. A mold manufacture using axial demolding and an injection molding are performed and the parting models are connected. Therefore, the axial air moving device with overlapped blades and better fluid performance is achieved through the axial demolding method.

5 Claims, 9 Drawing Sheets

(56) References Cited

U.S. PATENT DOCUMENTS 6,877,958 B2 * 4/2005 Lin ..... B29C 33/005 416/243
6,986,644 B2 * 1/2006 Shaw ..... F04D 29/2227 416/185
7,083,386 B2 * 8/2006 Horng ..... F04D 29/329 416/200 R
7,182,572 B2 * 2/2007 Yang ..... F04D 29/329 415/203
7,306,429 B2 * 12/2007 Horng ..... F04D 29/325 415/220
7,401,638 B2 * 7/2008 Lin ..... B22D 17/005 164/137
9,410,557 B2 * 8/2016 Kuo ..... F04D 29/34
10,202,981 B2 * 2/2019 Lin ..... F04D 17/025
11,268,535 B2 * 3/2022 Lin ..... F04D 29/624
2002/0023728 A1 * 2/2002 Kikuchi ..... F04D 29/325 164/113
2003/0185682 A1 * 10/2003 Lei ..... F04D 29/325 416/212 R
2009/0110558 A1 * 4/2009 Choi ..... F04D 29/384 416/223 R
2009/0297344 A1 * 12/2009 Hill ..... F04D 29/284 415/208.1
2010/0166567 A1 * 7/2010 Calley ..... F03D 1/00 416/223 R
2014/0064973 A1 * 3/2014 Ren ..... F04D 29/388 29/889.6
2015/0204342 A1 * 7/2015 Liang ..... B29C 33/485 416/223 R
2016/0168997 A1 * 6/2016 Garm ..... F03D 1/0675 416/223 R
2017/0030367 A1 * 2/2017 Cahill ..... F04D 29/34
2017/0334547 A1 * 11/2017 Holland ..... B29C 73/10
2018/0031003 A1 * 2/2018 Takeshita ..... F04D 29/681
2019/0093667 A1 * 3/2019 Inouchi ..... F04D 29/263
2019/0353179 A1 * 11/2019 Volk ..... F04D 29/242
2020/0114558 A1 * 4/2020 Hukatsu ..... B29C 70/12
2020/0164559 A1 * 5/2020 Hukatsu ..... B29C 45/0025
2020/0166047 A1 * 5/2020 Chang ..... F04D 29/388
2021/0062820 A1 * 3/2021 Lin ..... F04D 29/30
2022/0213897 A1 * 7/2022 Shih ..... B29C 45/2616

* cited by examiner

301

302

MANUFACTURING METHOD OF AXIAL AIR MOVING DEVICE WITH BLADES OVERLAPPED IN AXIAL PROJECTION

BACKGROUND OF THE DISCLOSURE

Technical Field

The technical field relates to an axial air moving device, and more particularly relates to a manufacturing method of a blade for an axial air moving device with high-performance.

Description of Related Art

Generally, the axial air moving device is composed of a motor, a hub and a plurality of blades arranged around the hub. The motor drives the hub to rotate to let the blades push the fluid flowing. Moreover, the axial air moving device has to generate not only high air volume, but also sufficient air pressure to effectively overcome the flow resistance of the environment. Accordingly, in order to improve the characteristics of static pressure-air volume of the axial air moving device, the optimal performance is mostly obtained by adjusting the size and angle of the blades. When high air pressure is required, the designs of the blades with blades overlapped in the axial direction projection may be needed.

In the situation of blades overlapped in the axial direction projection, the radial demolding method was commonly adopted because the blades cannot be demolded from the axial direction in mass production. However, when the radial demolding method is adopted, the blades need to be designed with relatively simple geometry, such as a straight airfoil, due to the restriction of the demolding path, and that causes the geometrical shape of blades failing to be in the ideal shapes. Therefore, the blades having overlapped area in axial projection of varied geometries, such as varying blade angle at different radius positions, twisted blades with high skew angles or blades configured by non-planar stacking, etc., are restricted to be embodied because such blades cannot be manufactured by the radial demolding method. Thus, the better fluid performance cannot be achieved.

In view of the above drawbacks, the inventor proposes this disclosure based on his expert knowledge and elaborate researches in order to solve the problems of related art.

SUMMARY OF THE DISCLOSURE

One object of this disclosure is to provide a manufacturing method of an axial air moving device with blades overlapped in the axial projection. The shapes of the blades of the axial air moving device manufactured by proposed method are not restricted by the radial demolding method, and the better fluid performance is then achieved when the axial air moving device is in operation.

In order to achieve the object mentioned above, this disclosure provides a manufacturing method of an axial air moving device with blades overlapped in the axial projection. The method includes: providing a model of the axial air moving device which includes a hub and a plurality of blades arranged annularly on a peripheral surface of the hub spacedly, and each of the blades is overlapped in the axial direction of the hub; parting off the model of the axial air moving device in the axial direction of the hub to divide the blades into at least one first blade and at least one second blade non-overlapped in the axial projection respectively and to form a plurality of parting models; performing a mold manufacture using axial demolding to the parting models to form at least one first mold and at least one second mold; performing an injection molding by using the first mold and the second mold, the first mold forming a first parting model including a plurality of first blades and a second parting model including a plurality of second blades; and connecting the first parting model and the second parting model to form the complete axial air moving device; wherein, the second blades are connected to the first blades forming the continuous blade surface as a whole.

Comparing with the related art, the edge of the blades of this disclosure can be non-linear manner, and each blade has a partially overlapped projection in the axial direction, such kind of axial air moving device cannot be manufactured by the radial demolding method of previous art. Moreover, the axial air moving device of this disclosure are parted in the axial direction to form a plurality of parting models, and each blade is divided into multiple sub-blades having non-overlapped area in the axial projection and to form a plurality of parting models. Then, the mold manufacture using axial demolding to the parting models and an injection molding with the molds are performed to form the parting models. Finally, the parting models are connected to form the blades with a curved surface in a continuous manner. Therefore, the blades overlapped in the axial projection are produced through the axial demolding method instead of the radial demolding method. The limitation on the blade geometry in radial demolding method is removed by this disclosure. Thus, the axial air moving device could achieve better aerodynamic performance.

BRIEF DESCRIPTION OF DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
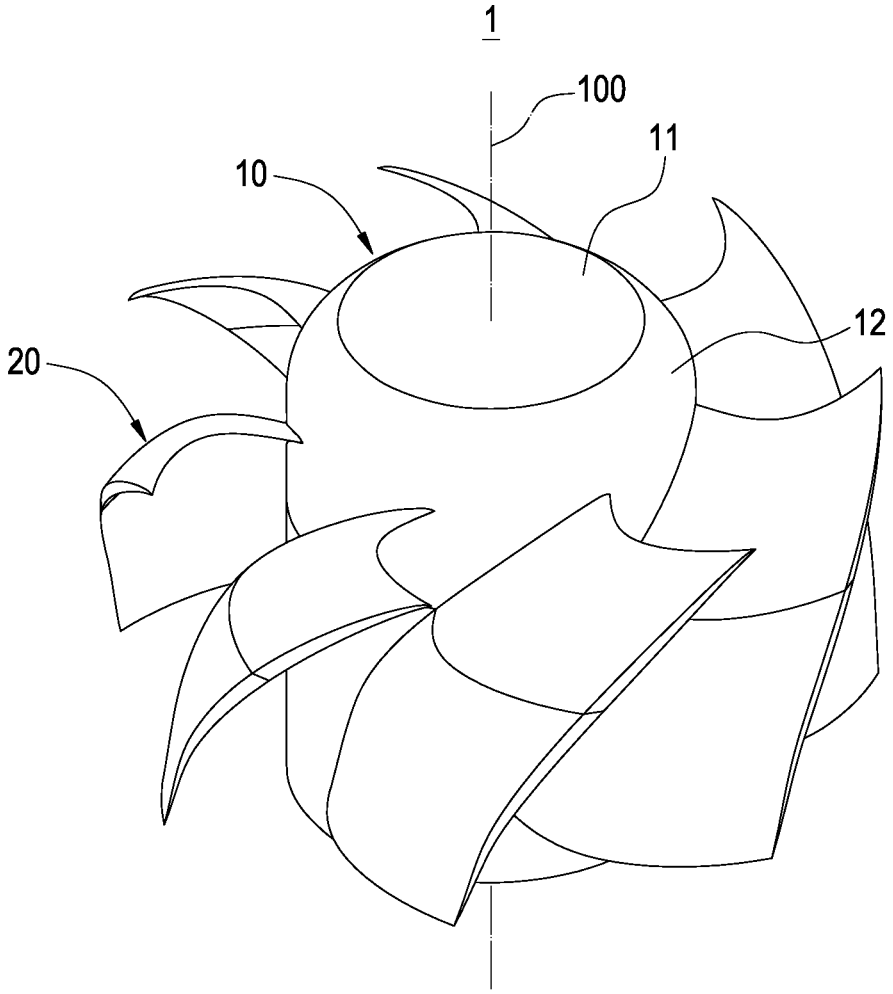
FIG. 1 is a perspective schematic view of the axial air moving device with the blades overlapped in the axial projection of this disclosure.
Figure 2:
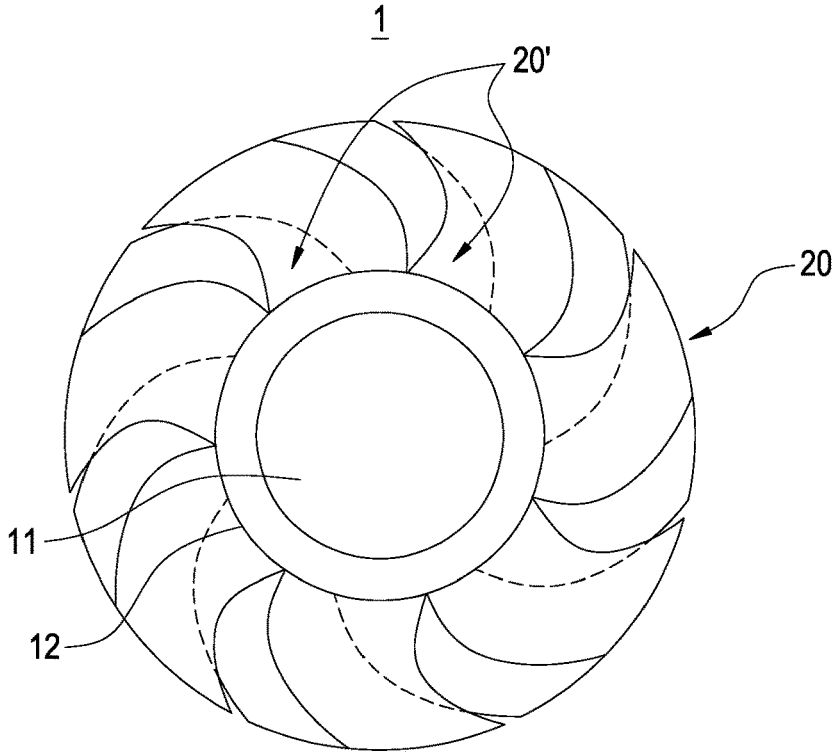
FIG. 2 is a top view of the axial air moving device with the blades overlapped in the axial projection of this disclosure.

Please refer to FIG. 1 and FIG. 2, which depict a perspective schematic view and a top view of the axial air moving device with the blades overlapped in the axial projection of this disclosure. The axial air moving device 1 with the blades overlapped in the axial projection of this disclosure includes a hub 10 and a plurality of blades 20. The hub 10 includes a top surface 11 and a peripheral surface 12 connected to the top surface 11, and the hub 10 has an axial direction 100. In addition, the blades 20 are arranged annularly on the peripheral surface 12 of the hub 10 spacedly to configure the axial air moving device 1.

It is worth noting that the edge of each blade 20 is not arranged in a linear manner, and each blade 20 has an axial projection 20' overlapped partially in the axial direction 100. In some embodiments, the ratio of the diameter of the hub 10 to the diameter of the blades 20 is greater than 0.25.

Please further refer to FIG. 3, FIG. 4, FIG. 5A and FIG. 5B, which depict a schematic view of parting the axial air moving device with the blades overlapped in the axial projection of this disclosure, an exploded schematic view of the parting models of the axial air moving device with the blades overlapped in the axial projection of this disclosure and a top view of two parting models of the axial air moving device with the blades overlapped in the axial projection of this disclosure. The axial air moving device 1 of this disclosure may include a plurality of parting models 300 parted in the axial direction, and each blade 20 is divided into at least one first blade 21 and at least one second blade 22, which are non-overlapped in the axial projection respectively.

Specifically, one end of each first blade is connected to the hub 10 and the other end of each first blade is located on the same height with respect to the top surface of the hub 10. Moreover, each of the second blades 22 is connected to each first blade 21 correspondingly, so that each blade 20 is formed to have a curved surface in a continuous manner.

Figure 3:
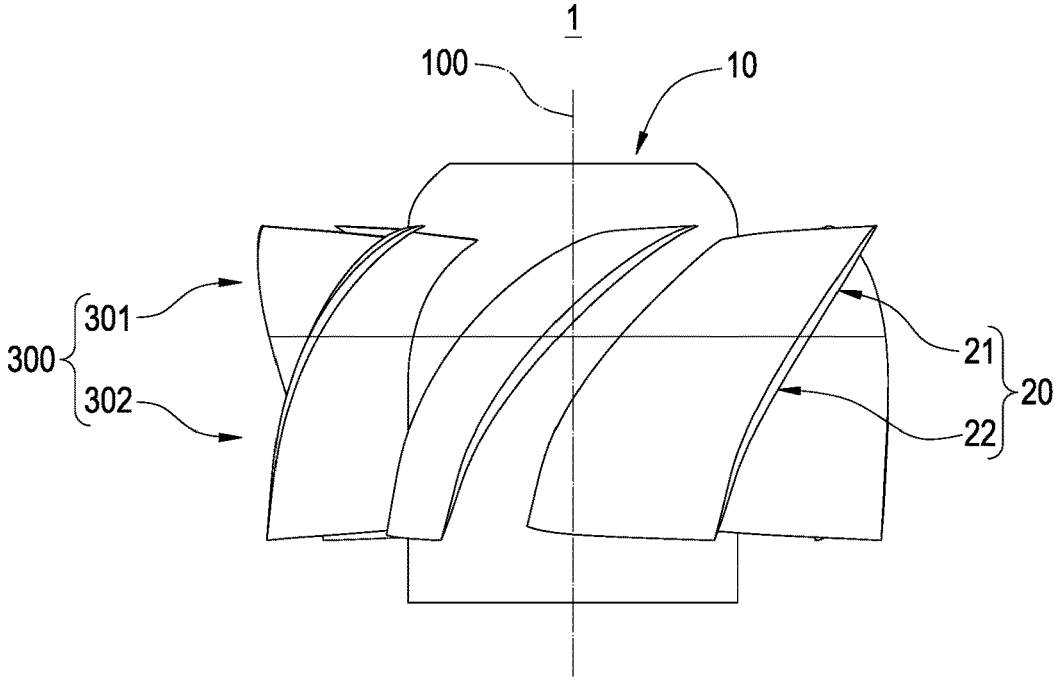
FIG. 3 is a schematic view of parting the axial air moving device with the blades overlapped in the axial projection of this disclosure.
Figure 4:
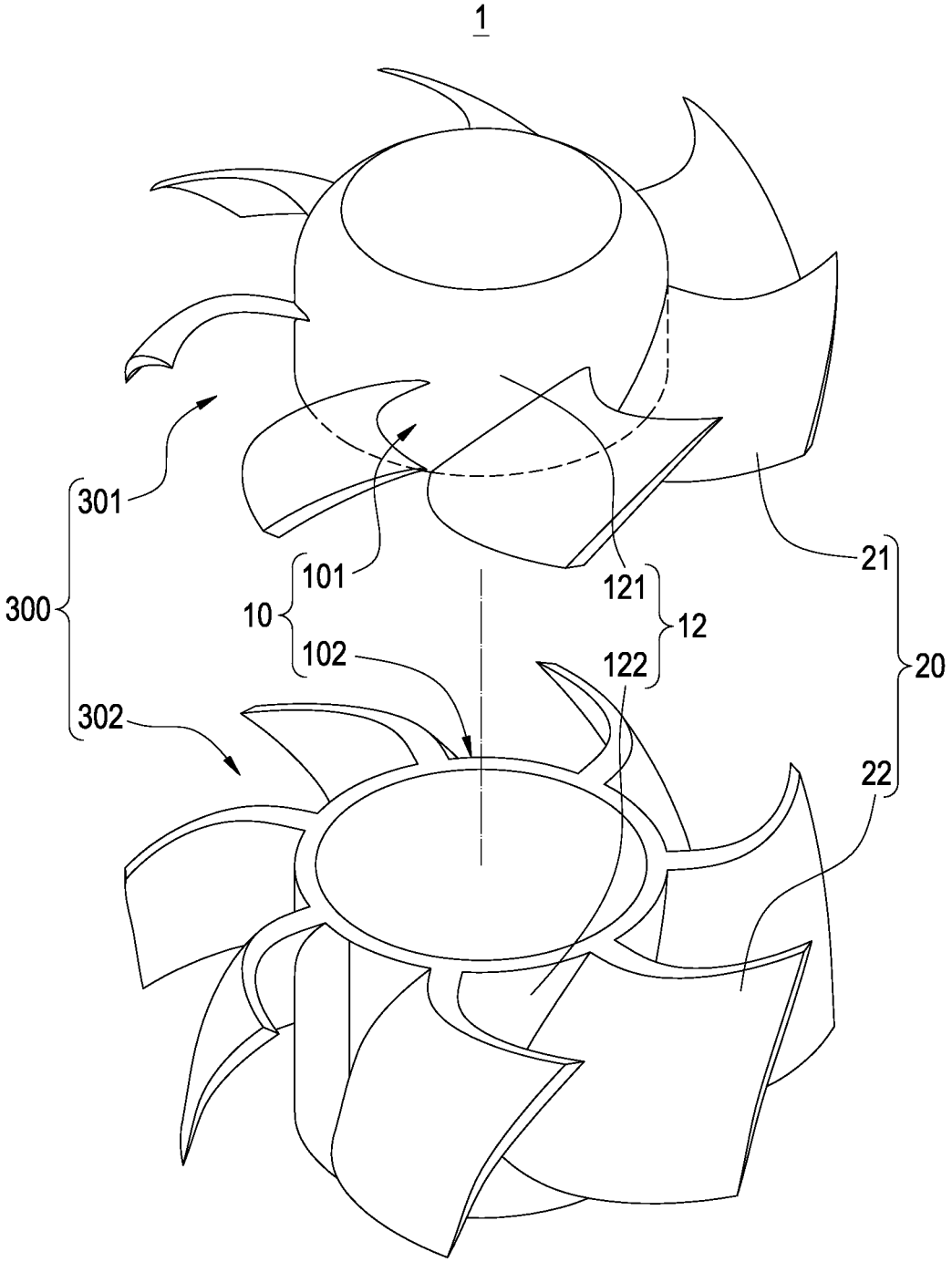
FIG. 4 is an exploded schematic view of the parting models of the axial air moving device with the blades overlapped in the axial projection of this disclosure.

Please refer to FIG. 3 and FIG. 4. In one embodiment of this disclosure, the parting models 300 include one first parting model 301 and one second parting model 302. The hub 10 includes a first hub 101 connected to the first blades 21 and a second hub 102 connected to the second blades 22. Furthermore, the first parting model 301 includes a plurality of first blades 21 and the first hub 101. The second parting model 302 includes a plurality of second blades 22 and the second hub 102.

Moreover, the peripheral surface 12 includes a first peripheral surface 121 connected to the first blades 21 and a second peripheral surface 122 connected to the second blades 22. The first hub 101 includes the first peripheral surface 121 and the top surface 11. The second hub 102 includes the second peripheral surface 122.

Figure 5A:
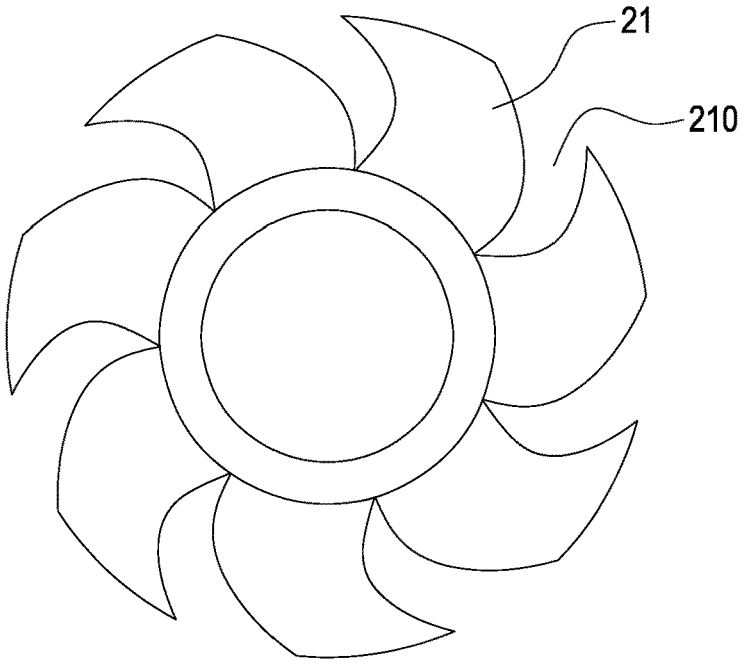
FIG. 5A and FIG. 5B are top views of two parting models of the axial air moving device with the blades overlapped in the axial projection of this disclosure.
Figure 5B:
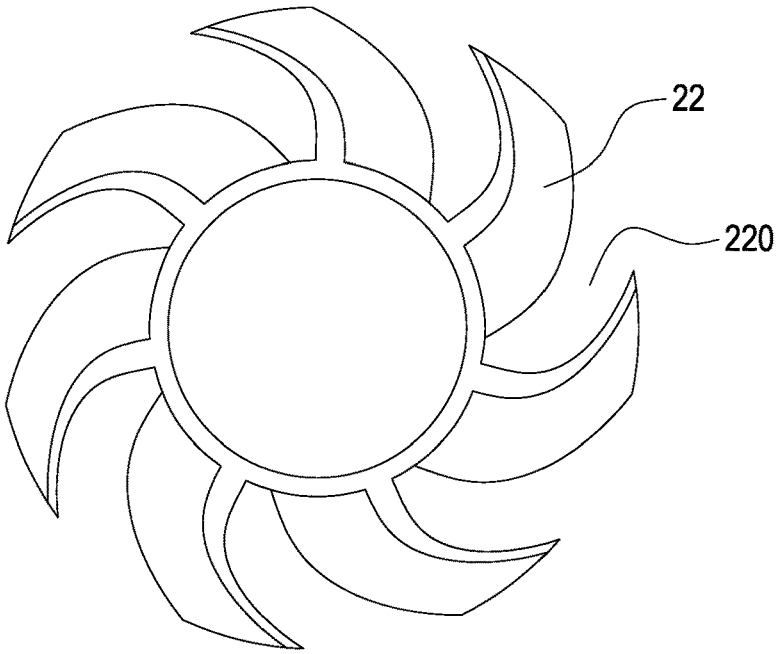

Please further refer to FIG. 5A and FIG. 5B. In one embodiment of this disclosure, a first gap 210 is located between any two first blades 21 adjacent to each other in the axial projection of the first parting model 301. Additionally, a second gap 220 is located between any two second blades 22 adjacent to each other in the axial projection of the second parting model 302. It is worth of noting that in some embodiments, after the axial air moving device 1 is parted, a gap may not be present (or defined) between the adjacent first blades 21 in the axial projection, and the axial projection of the first blades 21 are not overlapped. Similarly, a gap may not be present (or defined) between the adjacent second blades 22 in the axial direction, and the axial projection of the second blades 22 are not overlapped.

It should be noted that the processes of parting and dividing of the axial air moving device 1 of this disclosure 1 may be performed by the aforementioned rules to make a plurality of parting models 300. In one embodiment of this disclosure, the number of parting models 300 of the axial air moving device 1 is two. In some embodiments, the number of parting models 300 of the axial air moving device 1 may be equal to or more than two by the aforementioned rules. Moreover, in this embodiment, the blades 20 of the axial air moving device 1 are designed with different skew angles on the cross sections in different radius positions.

Figure 6:
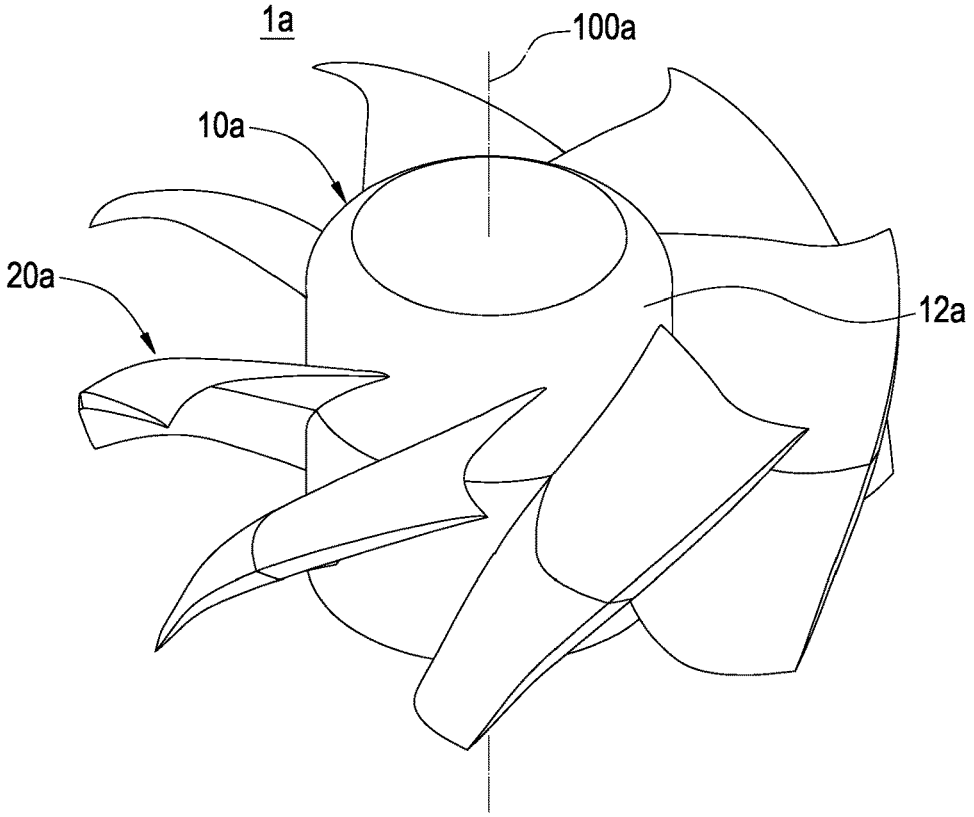
FIG. 6 is a perspective schematic view of another embodiment of the axial air moving device with the blades overlapped in the axial projection of this disclosure.
Figure 7:
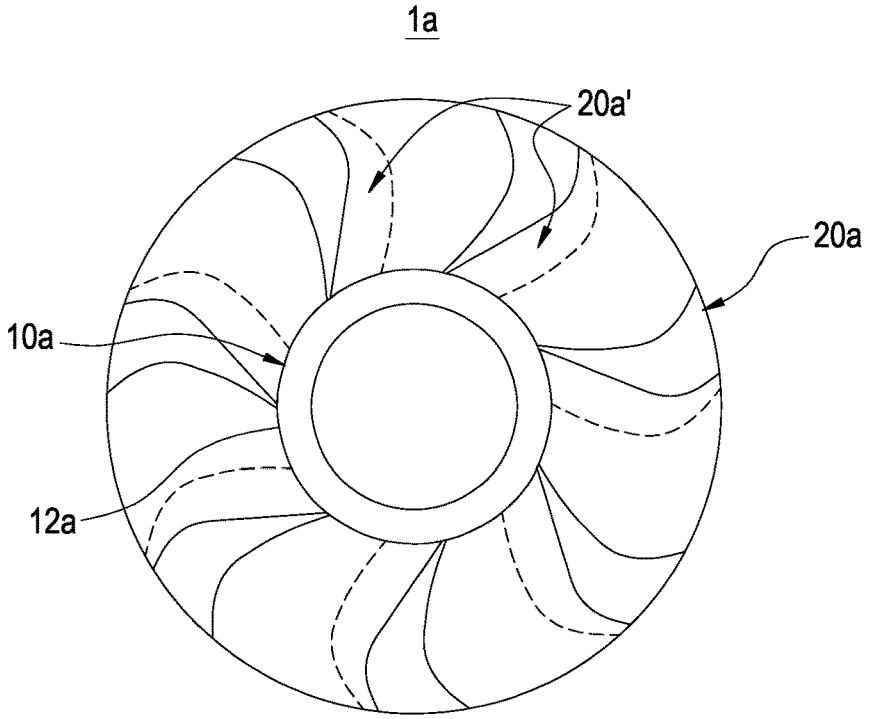
FIG. 7 is a top view of another embodiment of the axial air moving device with the blades overlapped in the axial projection of this disclosure.

Please further refer to FIG. 6 and FIG. 7, which depict a perspective schematic view of another embodiment of the axial air moving device with the blades overlapped in the axial projection of this disclosure and a top view of another embodiment of the axial air moving device with the blades overlapped in the axial projection of this disclosure. This embodiment is similar to the previous embodiment, the axial air moving device 1*a* includes a hub 10*a* and a plurality of blades 20*a*. The hub 10*a* includes a peripheral surface 12*a*, and the hub 10*a* has an axial direction 100*a*. In addition, the blades 20*a* are arranged annularly on the peripheral surface 12*a* of the hub 10*a* spacedly. Moreover, the edge of each blade 20*a* is not arranged in a linear manner, and the blade 20*a* has an axial projection 20*a*' overlapped partially in the axial direction 100*a*. The difference between this embodiment and the previous embodiment is that the blades 20*a* of the axial air moving device 1*a* have different blade angles of the cross sections on different radius positions, forming a twisted curved surface which cannot be demolded in the radial direction. Thus, the axial air moving device 1*a* needs to be formed by the manufacturing method of this disclosure.

Figure 8:
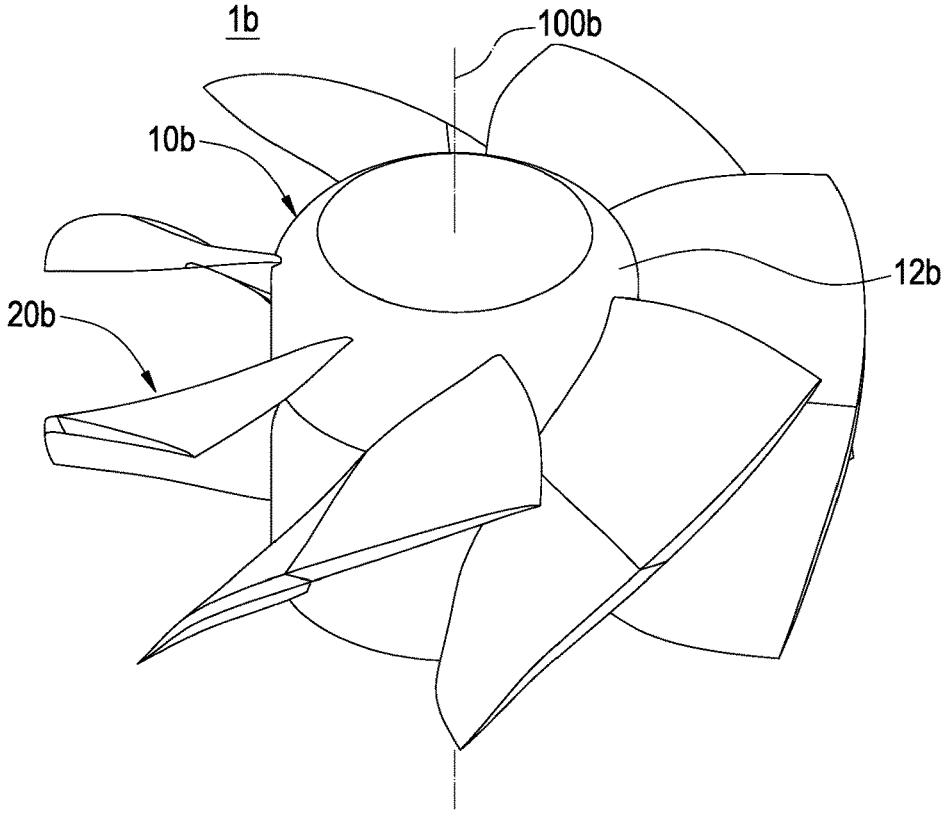
FIG. 8 is a perspective schematic view of a still another embodiment of the axial air moving device with the blades overlapped in the axial projection of this disclosure.
Figure 9:
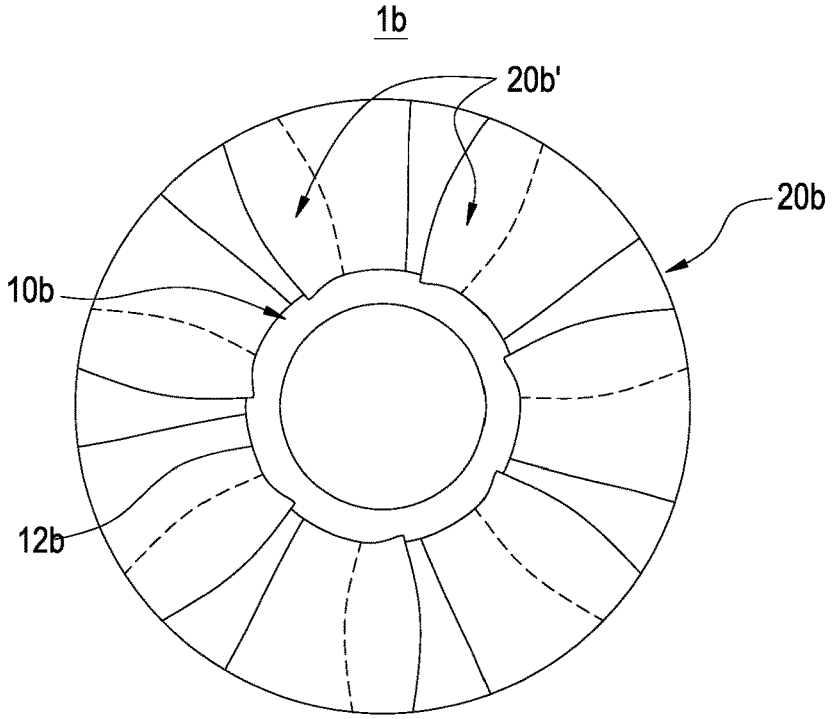
FIG. 9 is a top view of a still another embodiment of the axial air moving device with the blades overlapped in the axial projection of this disclosure.

Please further refer to FIG. 8 and FIG. 9, which depict a perspective schematic view of a still another embodiment of the axial air moving device with the blades overlapped in the axial projection of this disclosure and a top view of a still another embodiment of the axial air moving device with the blades overlapped in the axial projection of this disclosure. This embodiment is similar to the previous embodiment, the axial air moving device 1*b* with the blades overlapped in the axial projection of this disclosure includes a hub 10*b* and a plurality of blades 20*b*. The hub 10*b* includes a peripheral surface 12*b*, and the hub 10*b* has an axial direction 100*b*. In addition, the blades 20*b* are arranged annularly on the peripheral surface 12*b* of the hub 10*b* spacedly. Moreover, the edge of each blade 20*b* of this disclosure is not arranged in a linear manner, and the blade 20*b* has an axial projection 20*b*' overlapped partially in the axial direction. The difference between this embodiment and the previous embodiment is that the blades 20*b* of the axial air moving device 1*b* have different skew angles and different blade angles of the cross sections on different radius positions, forming a twisted curved surface that cannot be demolded in the radial direction. Thus, the axial air moving device 1*b* needs to be formed by the manufacturing method of this disclosure.

Figure 10:
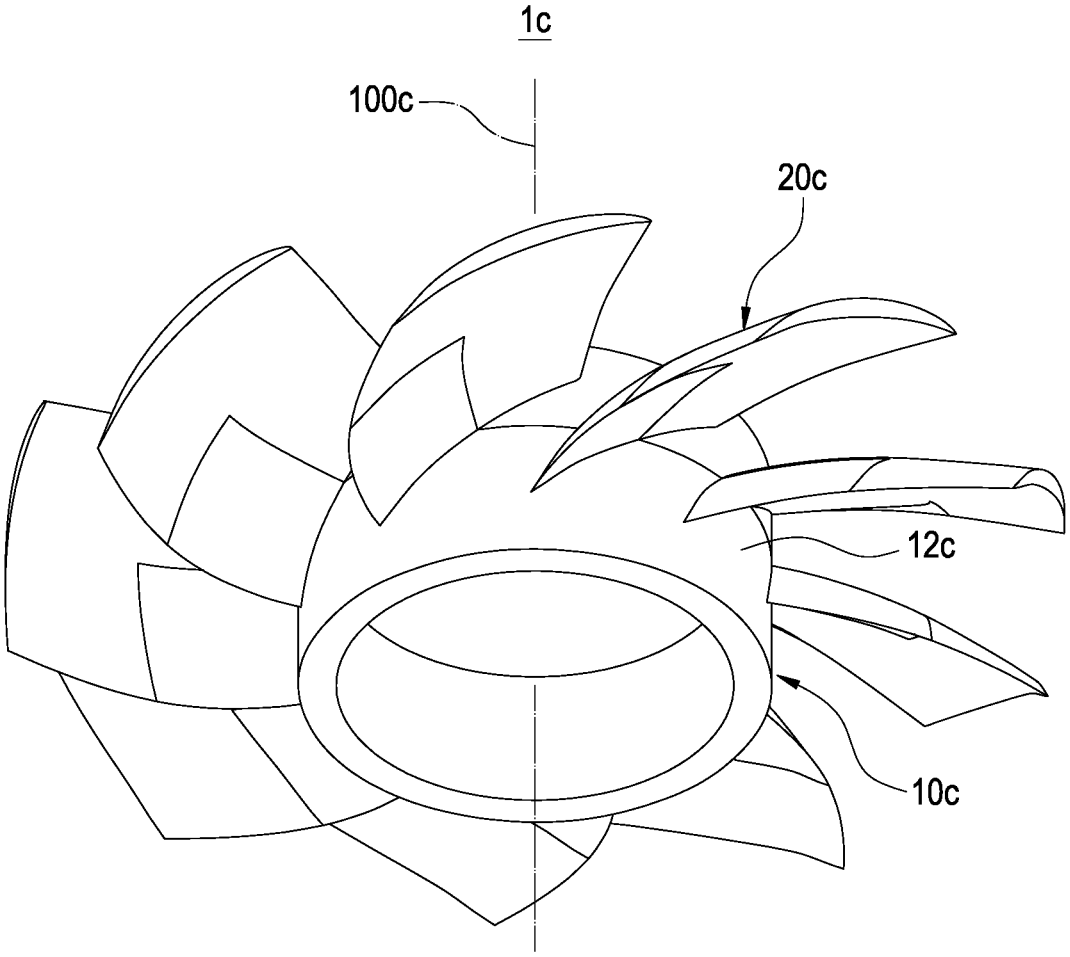
FIG. 10 is a perspective schematic view of another embodiment of the axial air moving device with the blades overlapped in the axial projection of this disclosure.
Figure 11:
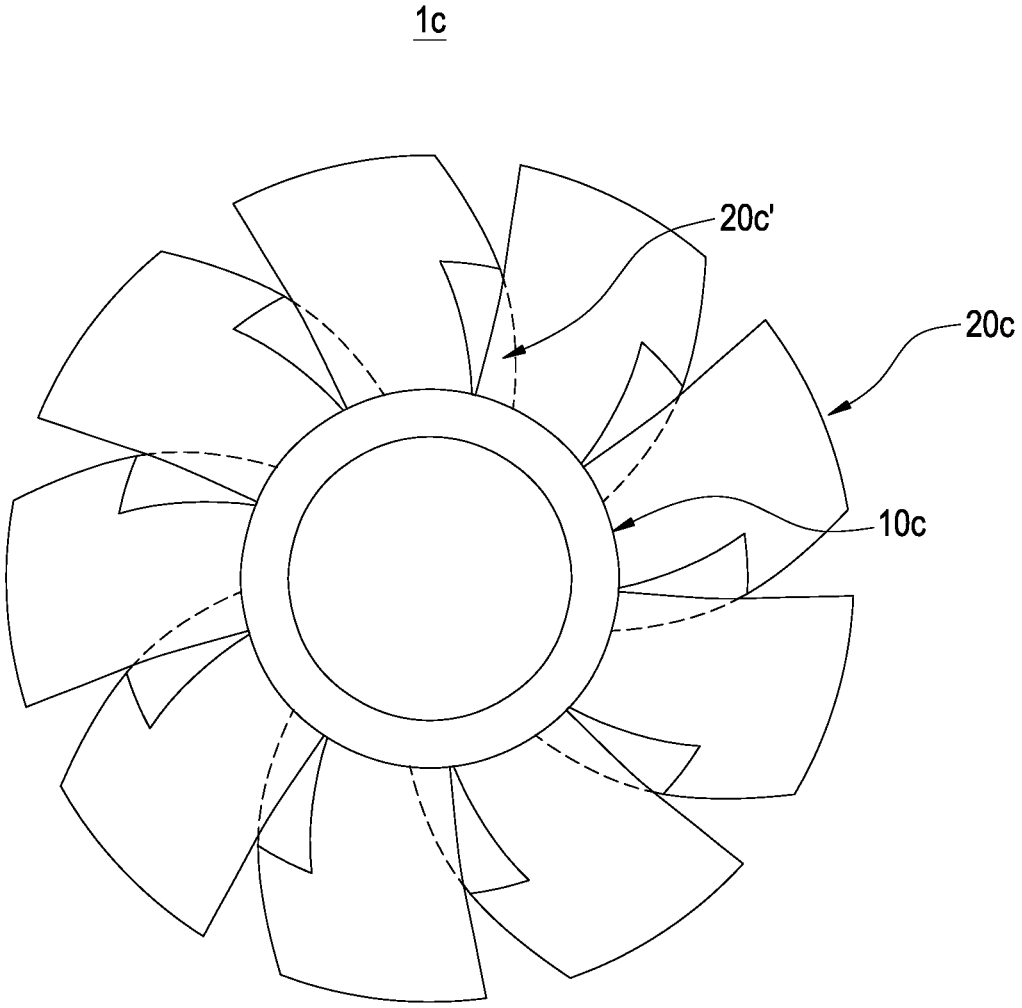
FIG. 11 is a top view of another embodiment of the axial air moving device with the blades overlapped in the axial projection of this disclosure.
Figure 12:
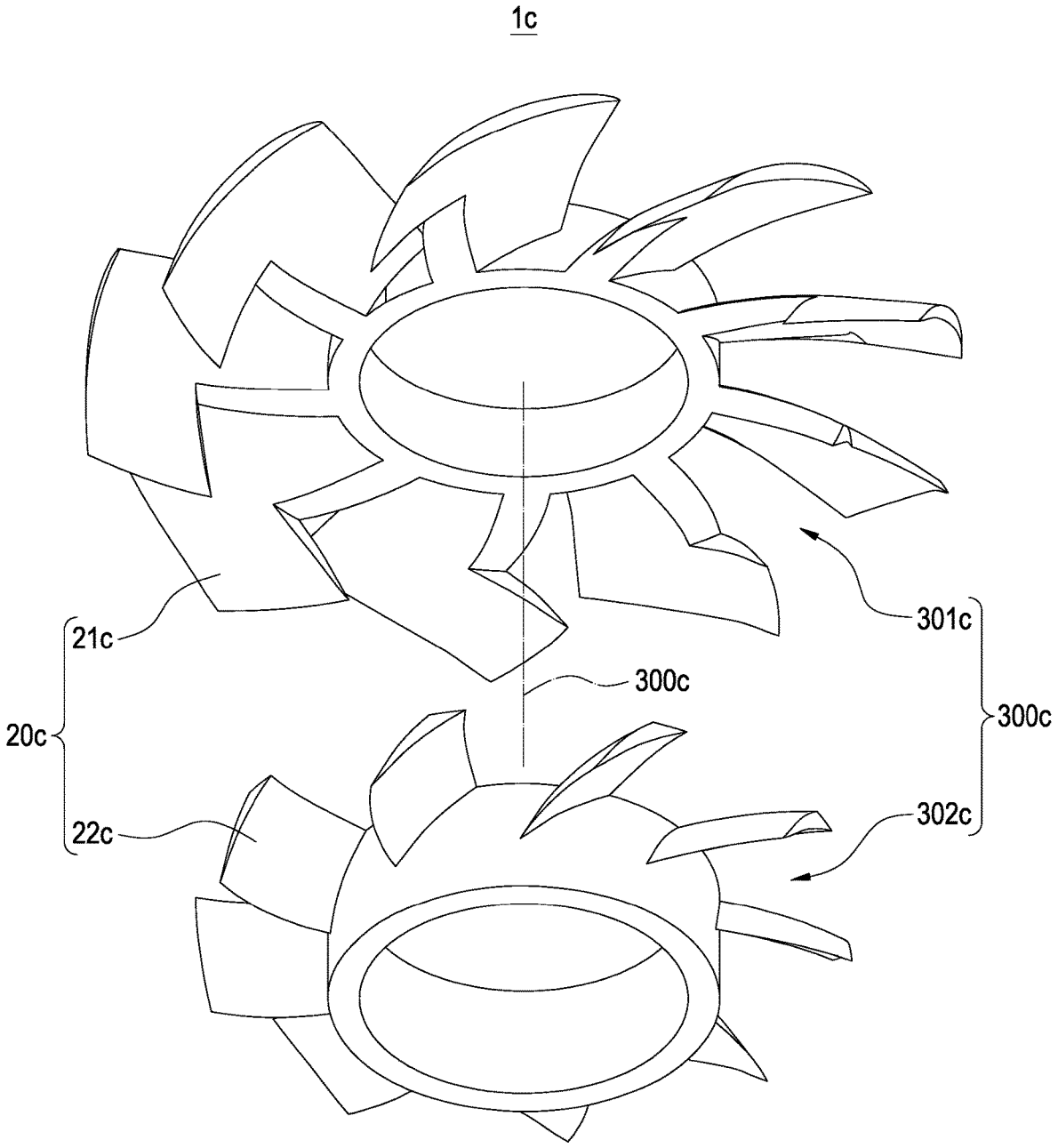
FIG. 12 is a perspective exploded view of another embodiment of the axial air moving device with the blades overlapped in the axial projection of this disclosure.

Please further refer to FIG. 10 to FIG. 12, which depict a perspective schematic view, a top view and a perspective exploded view of another embodiment of axial air moving device with the blades overlapped in the axial projection of this disclosure. This embodiment is similar to the previous embodiment, the axial air moving device 1*c* includes a hub 10*c* and a plurality of blades 20*c*. The hub 10*c* has an axial direction 100*c*. The blades 20*c* are arranged annularly on the peripheral surface 12*c* of the hub 10*c* spacedly. Additionally, each blade 20*c* has an axial projection 20*c*' overlapped partially in the axial direction 100*c*.

The difference between this embodiment and the previous embodiment is that the axial air moving device 1*c* is parted into a plurality of parting models 300*c* in the axial direction 100*c* in a non-coplanar manner. The parting models 300*c* include one first parting model 301*c* and one second parting model 302*c*, and each blade 20*c* is divided into at least one first blade 21*c* and at least one second blade 22*c*, which are non-overlapped in the axial projection respectively. Furthermore, the manufacturing method of the axial air moving device with the blades overlapped in the axial projection of this disclosure is as follows. First, a model of an axial air moving device is provided (step a). The model of the axial air moving device model 1 includes a hub and a plurality of blades arranged annularly on the peripheral surface of the hub, and each blade has an axial projection overlapped in the axial direction of the hub. Additionally, the model of the axial air moving device is parted in the axial direction of the hub to divide the blades into at least one first blade and at least one second blade, which are non-overlapped in the axial projection and to form a plurality of parting models (step b). It is worth noting that in some embodiments, the blade is divided into a plurality of sub-blades non-overlapped in the axial projection, and the number of the sub-blades may be equal to or more than two.

Subsequently, a mold manufacture using axial demolding of the parting models is performed to form at least one first mold and one second mold (step c) and an injection molding by the first mold and the second mold is performed. The first mold forms a first parting model including a plurality of first blades and a second parting model including a plurality of second blades (step d). It should be noted that the number of the molds in this example is two, and the number of the molds is corresponding to the number of sub-blades non-overlapped in the axial projection. It is worth noting that using the first parting mold and the second parting mold of this disclosure for the injection molding does not have to use the complex sliders applied in the radial demolding method. Therefore, the cost of molds, working hours and production cost may be reduced.

Finally, the first parting model and the second parting model are connected (refer to FIG. 4 in the previous embodiment) to form the axial air moving device. The second blades are connected to the first blades correspondingly, so that each of the blades is formed to have a curved surface in a continuous manner. Therefore, the manufacture of the axial air moving device is completed.

It should be noted that the connection method of the first parting model and the second parting model is not limited. In some embodiments, the connection is achieved by hot pressing, tight fitting, ultrasonic welding, bonding or engaging, etc.

While this disclosure has been described by means of specific embodiments, numerous modifications and variations could be made thereto by those skilled in the art without departing from the scope and spirit of this disclosure set forth in the claims.

What is claimed is:

1. A manufacturing method of an axial air moving device, comprising:

providing a model of the axial air moving device comprising a hub and a plurality of blades arranged annularly on a peripheral surface of the hub spacedly, and each of the blades being overlapped partially in an axial direction of the hub;

parting off the model of the axial air moving device in the axial direction of the hub to divide each of the blades into at least one first blade and at least one second blade which are non-overlapped in the axial projection respectively and to form a plurality of parting models;

performing a mold manufacture using axial-only demolding to the parting models to form at least one first mold and at least one second mold;

performing a respective injection molding by using the first mold and the second mold, the first mold forming a first parting model comprising a plurality of first blades, and a first hub connected with the first blades, and the second mold forming a second parting model comprising a plurality of second blades and a second hub connected with the second blades; and connecting the first parting model and the second parting model to form the axial air moving device by hot pressing, tight fitting, ultrasonic welding, bonding or engaging;

wherein the hub is formed by connecting the first hub and the second hub, and each of the blades is formed by connecting a corresponding first blade and a corresponding second blade together, and each of the corresponding first blade and the corresponding second blade connected to form a curved surface in a continuous manner;

wherein using the first parting mold and the second parting mold for injection moldings does not have to use sliders applied in the radial demolding.

2. The manufacturing method of the axial air moving device according to claim 1, wherein the hub of the axial air moving device comprises the first hub and the second hub, and the hub comprises a top surface, and one end of each first blade is connected to the hub and another end of each first blade is located on a same height with respect to the top surface of the hub.

3. The manufacturing method of the axial air moving device according to claim 1, wherein a first gap is located between any two first blades adjacent to each other in the axial projection of the first parting model; and a second gap is located between any two second blades adjacent to each other in the axial projection of the second parting model.

4. The manufacturing method of the axial air moving device according to claim 1, wherein the peripheral surface of the axial air moving device comprises a first peripheral surface and a second peripheral surface, and the first peripheral surface is connected with the first blades, and the second peripheral surface is connected with the second blades.

5. The manufacturing method of the axial air moving device according to claim 1, wherein the blades comprise a plurality of skew angles, a plurality of blade angles or a plurality of skew angles and a plurality of blade angles on a plurality of cross sections of a plurality of radius positions.

* * * * *